US010119252B2

(12) United States Patent
Campomanes

(10) Patent No.: US 10,119,252 B2
(45) Date of Patent: Nov. 6, 2018

(54) REINFORCEMENT SYSTEM FOR A TOOL ADAPTER

(71) Applicant: Caterpillar Inc., Peoria, IL (US)

(72) Inventor: Patrick Simon Campomanes, Washington, IL (US)

(73) Assignee: Caterpillar Inc., Deerfield, IL (US)

( * ) Notice: Subject to any disclaimer, the term of this patent is extended or adjusted under 35 U.S.C. 154(b) by 272 days.

(21) Appl. No.: 14/945,532

(22) Filed: Nov. 19, 2015

(65) Prior Publication Data

US 2017/0145664 A1 May 25, 2017

(51) Int. Cl.
*E02F 9/28* (2006.01)

(52) U.S. Cl.
CPC ..... *E02F 9/2833* (2013.01); *E02F 9/2825* (2013.01); *E02F 9/2858* (2013.01); *E02F 9/2883* (2013.01)

(58) Field of Classification Search
CPC ..... E02F 9/2825; E02F 9/2833; E02F 9/2841; E02F 9/285; E02F 9/2858; E02F 9/2883
See application file for complete search history.

(56) References Cited

U.S. PATENT DOCUMENTS 1,959,847 A 5/1934 Burskirk
2,108,075 A 2/1938 Mork
3,740,876 A 6/1973 Solokhin
3,762,079 A 10/1973 Lukavich et al.
3,851,413 A * 12/1974 Lukavich ..... E02F 9/2816 37/450
4,267,653 A 5/1981 Hahn et al.
4,587,751 A 5/1986 Sjogren et al.
5,526,592 A * 6/1996 Bierwith ..... E02F 9/2825 172/772.5
5,653,048 A 8/1997 Jones et al.
6,151,812 A * 11/2000 Bierwith ..... E02F 9/2825 37/446
6,986,216 B2 1/2006 Emrich et al.
9,605,416 B2 * 3/2017 Campomanes ..... E02F 9/2825
2007/0204490 A1 9/2007 Jones et al.
2012/0246982 A1 10/2012 Bentley
(Continued)

OTHER PUBLICATIONS

Bradken; "Defender Wing Shrouds", located at <http://groundengagingtools.com/twistlokpro/shrouds.html>, Copyright 2013, accessed Oct. 23, 2015, 2 pages.

*Primary Examiner* — Jessica H Lutz
(74) *Attorney, Agent, or Firm* — Law Office of Kurt J. Fugman LLC

(57) ABSTRACT

A tool adapter for attaching a tool to a work implement using a retaining mechanism that includes a body that defines a pocket that defines an abutment or reinforcement surface. The body may include a nose portion that is configured to facilitate the attachment of a tool, a first leg, a second leg, a throat portion that connects the legs and nose portion together, wherein at least one leg defines an aperture that is configured to receive a retaining mechanism. The first and second legs and the throat portion also define a slot that includes a closed end and an open end that defines a direction of assembly onto a work implement and the minimum distance measured from the abutment surface to the throat measured in the direction of assembly is less than the minimum distance from the aperture to the throat measured in the direction of assembly.

11 Claims, 11 Drawing Sheets

(56) References Cited

U.S. PATENT DOCUMENTS

| | | | | |
|---|---|---|---|---|
| 2016/0362873 | A1* | 12/2016 | Campomanes | E02F 3/40 |
| 2017/0328033 | A1* | 11/2017 | Campomanes | E02F 9/2825 |
| 2017/0328034 | A1* | 11/2017 | Campomanes | E02F 9/2883 |

* cited by examiner

REINFORCEMENT SYSTEM FOR A TOOL ADAPTER

TECHNICAL FIELD

The present disclosure relates to the field of machines that perform work on a material such as earth moving machines and the like. Specifically, the present disclosure relates to a ground engaging tool adapter that can hold tools onto the lips of excavating buckets and the like.

BACKGROUND

During normal use on machines such as mining machines including electric rope shovels, ground engaging tool adapters may experience stresses in their legs that straddle the lips of excavating buckets and the like. It is not uncommon for these components to see extremely high loads due to severe operating or material conditions. Typically, when this occurs, the legs of the adapters may fall off the bucket or the like. This can lead to undesirable downtime for the machine while these parts are replaced.

FIG. 1 illustrates a power or mining shovel 100 as is known in the art. The type of shovel shown is an electric rope shovel and includes a bucket 102 for excavating material in mining or quarry environments. The bucket 102 has a lower front lip 104 to which is attached a plurality of tool adapters 106 and tools 108 that are configured to break up material to facilitate its intake into the interior of the bucket 102. FIG. 2 shows an enlarged view of such a similar bucket 102 in isolation from the machine that has an alternating sequence of adapters 106 with tips or tools 108 that is different than those described later in FIG. 3 and those adapters 106' and tools or tips 108' that are similar to those described later in FIG. 3.

SUMMARY

A tool adapter for attaching a tool to a work implement using a retaining mechanism is provided that includes a body that defines a pocket that defines an abutment or reinforcement surface. The body may also include a nose portion that is configured to facilitate the attachment of a tool, a first leg that includes a side surface, a second leg that includes a side surface, a throat portion that connects the legs and nose portion together, wherein at least one leg defines an aperture that is configured to receive a retaining mechanism. The first and second legs and the throat portion also define a slot that includes a closed end and an open end. The slot may define a direction of assembly onto a work implement and the abutment surface may face toward the direction of assembly and the minimum distance measured from the abutment surface to the throat measured in the direction of assembly is less than the minimum distance from the aperture to the throat measured in the direction of assembly.

A tool adapter for attaching a tool to a work implement using a retaining mechanism is provided that includes a body that includes a protrusion that extends from a side surface of a leg that defines an abutment or reinforcement surface. The body may also include a nose portion that is configured to facilitate the attachment of a tool, a first leg that includes a side surface, a second leg that includes a side surface, a throat portion that connects the legs and nose portion together, wherein at least one leg defines an aperture that is configured to receive a retaining mechanism. The first and second legs and the throat portion also define a slot that includes a closed end and an open end. The slot may define a direction of assembly onto a work implement and the abutment surface may face toward the direction of assembly and the minimum distance measured from the abutment surface to the throat measured in the direction of assembly is less than the minimum distance from the aperture to the throat measured in the direction of assembly.

A tool adapter assembly for use with a work tool that includes a lip is provided. The assembly may include a tool adapter for attaching a tool to a work implement using a retaining mechanism is provided that includes a body that defines a reinforcement surface. The body may also include a nose portion that is configured to facilitate the attachment of a tool, a first leg that includes a side surface, a second leg that includes a side surface, a throat portion that connects the legs and nose portion together, wherein at least one leg defines an aperture that is configured to receive a retaining mechanism. The first and second legs and the throat portion also define a slot that includes a closed end and an open end. The slot may define a direction of assembly onto a work implement and the abutment surface may face toward the direction of assembly and the minimum distance measured from the reinforcement surface to the throat measured in the direction of assembly is less than the minimum distance from the aperture to the throat measured in the direction of assembly. The assembly may further include a stop member that is at least partially complimentary configured to mate with the reinforcement surface.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings.

Figure 1:
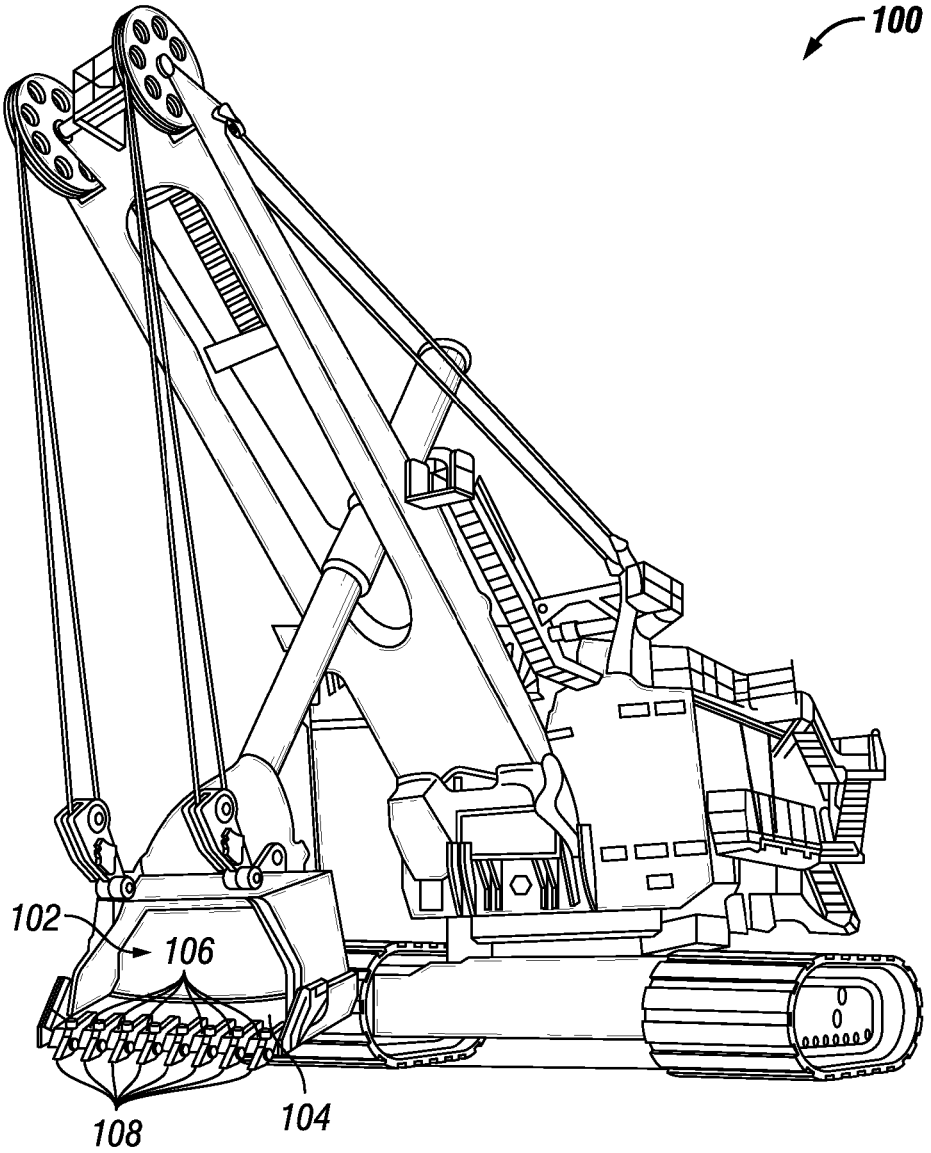
FIG. 1 (Prior Art)
FIG. 1 is a perspective view of a mining shovel as is known in the art.

Cartesian coordinate systems are provided in the drawings.

DETAILED DESCRIPTION

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* etc. It is to be understood that the use of letters immediately after a reference number indicates that these features are similarly shaped and have similar function as is often the case when geometry is mirrored about a plane of symmetry. For ease of explanation in this specification, letters will often not be included herein but may be shown in the drawings to indicate duplications of features discussed within this written specification.

Figure 2:
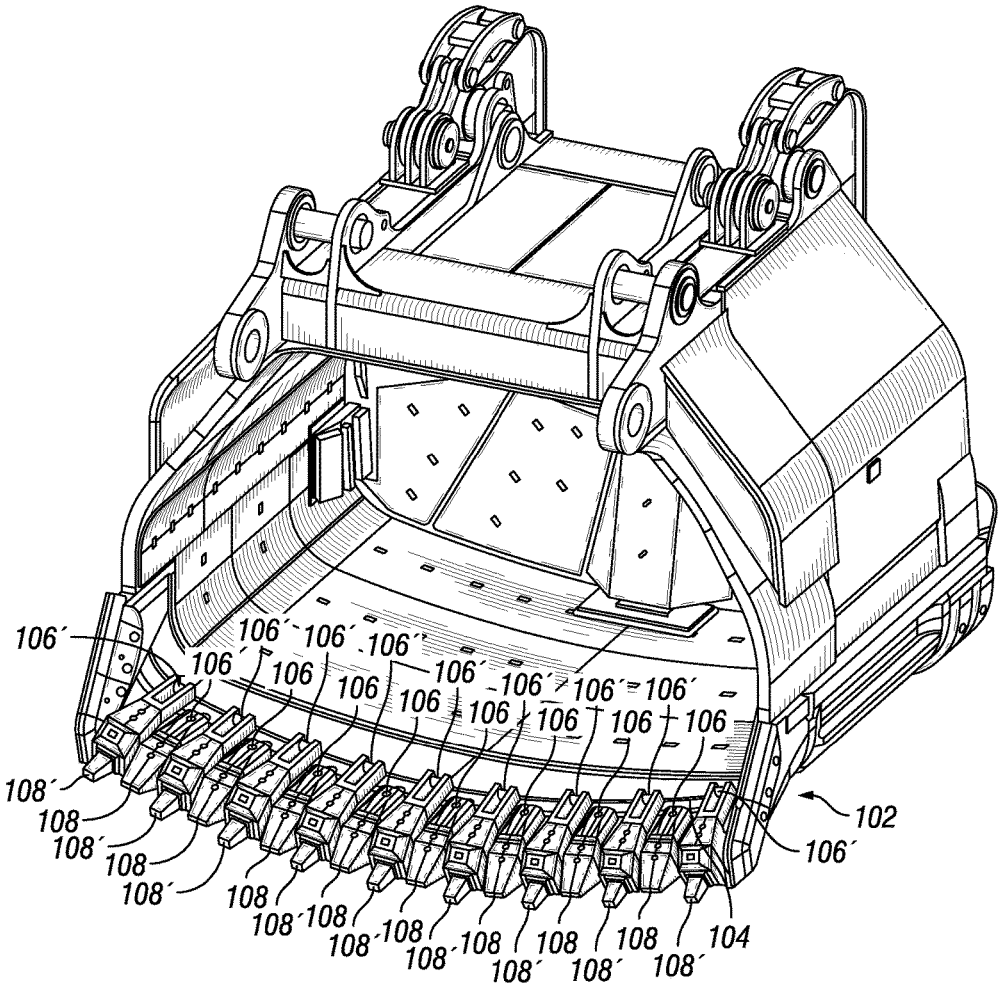
FIG. 2 (Prior Art)
FIG. 2 is a perspective view of a bucket shown in isolation from a mining shovel.
Figure 3:
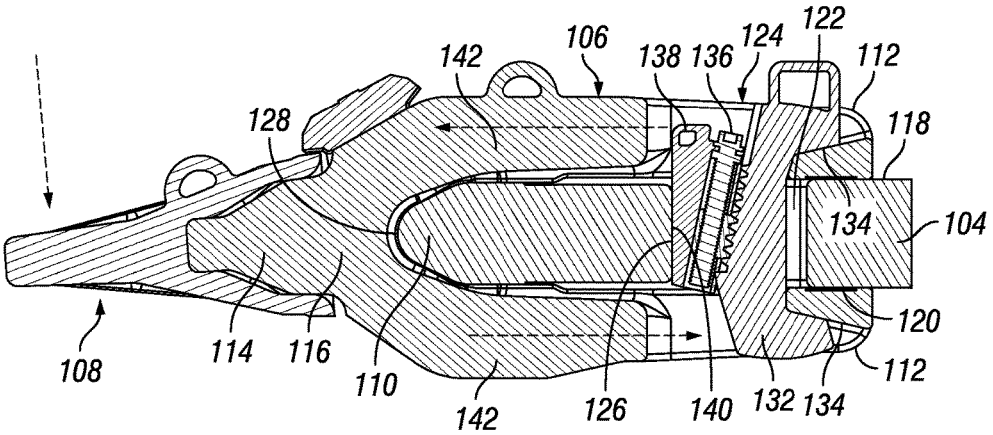
FIG. 3 is an enlarged sectional view of a tool, adapter and retaining mechanism attached to a lower front lip of a bucket such as those shown in FIGS. 1 and 2, illustrating the mechanics caused by a downward load on the tip.

FIG. 3 is a cross-sectional view of an adapter 106 and tip 108 that are attached to the front edge 110 of a lip 104 of a bucket such as that shown in FIGS. 1 and 2. As shown, the legs 112 diverge from the nose 114, forming a throat portion 116 that connects the nose and legs together. The legs 112 straddle the top surface 118 and bottom surface 120 of the lip 104 of the bucket 102. A hole or aperture 122 extends through lip 104 from the top surface 118 to the bottom surface 120. A retaining mechanism 124 that is well known in the art is shown in place in this aperture 122 that engages both the legs 112 of the adapter 106 and the front 126 of the aperture 122, preventing the adapter 106 from moving forward towards the lip 104. At the same time, the throat 116 of the adapter 106 contacts the radius 128 of the front edge 110 of the lip 104, preventing the adapter from moving backwards toward the interior of the bucket.

Any play between the lip 104 and the adapter 106 is removed by the retaining mechanism 124 that includes a cam member or wedge 132 that pushes back on forward facing sloped surfaces 134 located near the rear of the adapter 106 proximate the aperture 122 for the retaining mechanism. The pushing action is caused by rotating the spool 136 that causes it and its holding member 138 to travel downwards into the aperture until contact is made between the front face 140 of the holding member 138 and the front face 126 the aperture 122, while at the same time the wedge member 132 contacts the adapter 106 and pushes the adapter back until the radius 128 of the front edge 110 of the lip 104 contacts the throat 116 of the adapter 106.

During a load cycle on the tool and adapter during operation, forces are transferred from the tool or tip to the adapter nose. These forces tend to cause the legs of the adapter, which usually straddle the lip of the bucket or the like on the top and bottom sides, to spread apart.

As can be seen from FIG. 3, nothing prohibits the front portions 142 of the upper and lower legs 112 from moving forwards and rearwards respectively when a counterclockwise torque or moment is induced by a force acting downward on the tip or tool 108. Of course, the forces and stresses are reversed when an upward force acts on the tip or tool, which may be equally problematic.

Looking now at FIGS. 4 thru 7, a work tool assembly 200 that comprises a tool adapter 202 for attaching a tool (not shown) to a work implement 204 using a retaining mechanism 206 is shown. While the work tool assemblies and implements discussed thus far have been limited mostly to buckets and the like, it should be noted that other work implements such as rakes, shears, etc. are also included in the present disclosure. Generally speaking, a work implement is anything that manipulates a work material such as dirt, rock, wood, steel, etc., while a tool or tip actually contacts and does the majority of work on the work material.

The adapter 202 shown in these figures includes a body 208 that defines Cartesian coordinate system or X, Y, and Z directions. The body 208 includes a nose portion 210, a first leg 212 that includes a side surface 214, a second leg 216 that includes a side surface 218, a throat portion 220 that connects the legs 212, 216 and nose portion 210 together and at least one leg that defines an aperture that is configured to receive a retaining mechanism 206. For this embodiment, both legs 212, 216 define an aperture 222 that is configured to receive the retaining mechanism 206. Furthermore, the aperture 222 is shown to be a slot having an elongated shape in the direction of assembly of the adapter onto a work implement. Also, the nose is configured to have a boss 240 or other feature that facilitates the attachment of a tool or tip to the adapter. All of these features are also present in FIG. 3.

Figure 6:
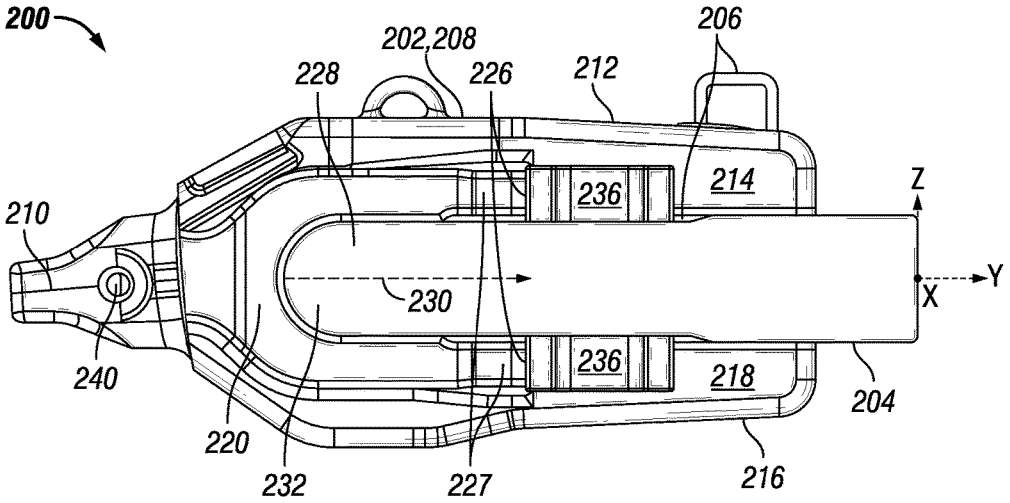
FIG. 6 is a side view of the tool adapter, retaining mechanism, and stop member and lip of a bucket as shown in FIG. 4.
Figure 7:
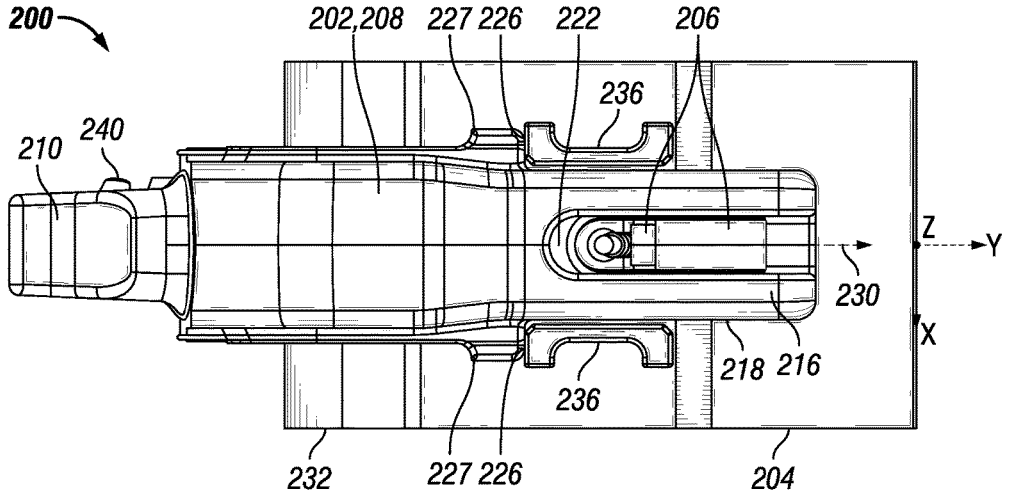
FIG. 7 is a bottom view of the tool adapter, retaining mechanism, and stop member and lip of a bucket as shown in FIG. 4.

However, the body 208 of the adapter 202 also includes or defines an abutment surface 226. For this embodiment, the body 208 of the adapter 202 includes a protrusion 227 that extends from the side surface 214, 218 of a leg 212, 216 and the abutment surface 226 is actually on the rearward facing surface of that protrusion, that is to say that the abutment surface faces toward the direction of assembly 230. As best seen in FIG. 6, the first and second legs 212, 216 and the throat portion 220 define a slot 228 that includes a closed end and an open end. Moving from the closed end of the slot toward the open end defines a direction of assembly 230 onto a work implement. For this embodiment, the adapter 202 is attached to the lower front lip 232 of a bucket but the adapter and reinforcement system could be attached to the edge of any work implement. Consequently, the term "lip" should be interpreted broadly and includes any edge of a work implement.

Figure 11:
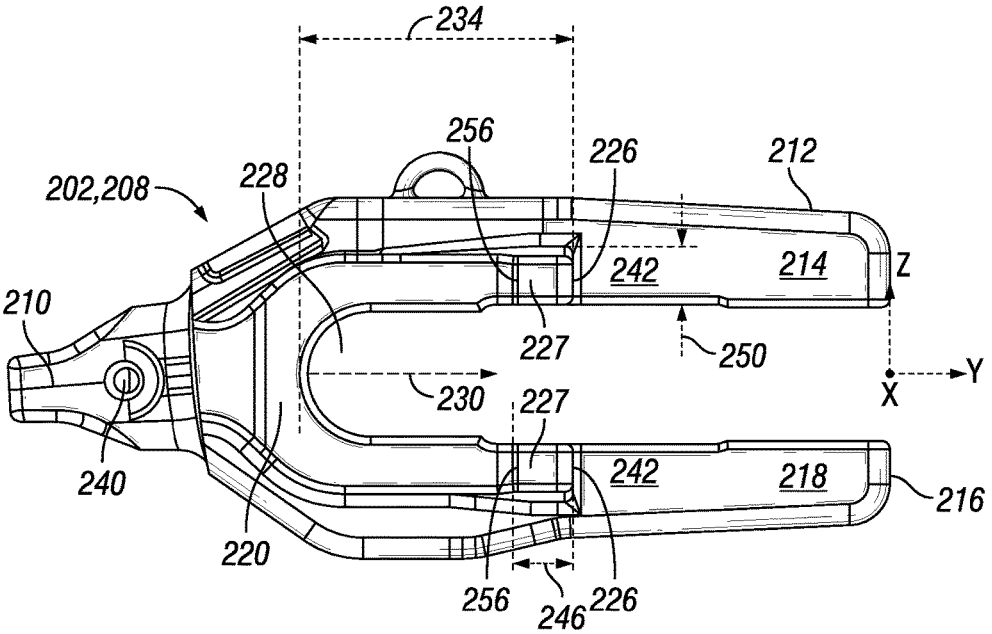
FIG. 11 is a side view of the tool adapter of FIG. 10.
Figure 12:
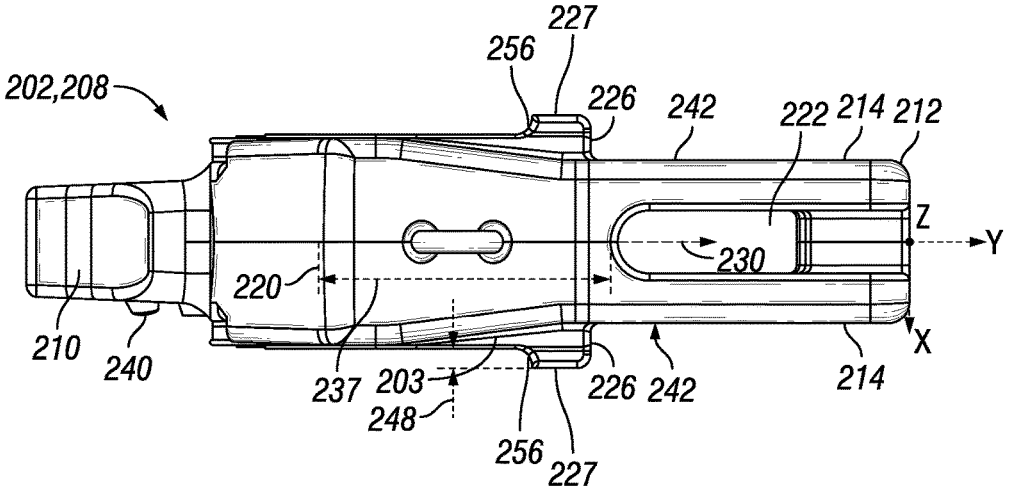
FIG. 12 is a top view of the tool adapter of FIG. 10.

As best seen in FIGS. 11 and 12, the minimum distance 234 measured from the abutment surface 226 to the throat 220 measured in the direction of assembly 230 is less than the minimum distance 237 from the aperture 222 to the throat 220 measured in the direction of assembly 230. The direction of assembly 230 is shown to be in the general Y direction in FIGS. 4 thru 9.

FIGS. 4 thru 9 show that a reinforcement or stop member 236 is provided that is at least partially complimentary configured to mate with the abutment surface 226 of the body 208 of the adapter 202. Both the lip 232 and the adapter 202 define apertures 122, 222 that may be aligned once the adapter is fully slid onto the lip (best seen in FIG. 18). When completed as shown, the retaining mechanism 206 is positioned at least partially in the apertures of the adapter and the lip, preventing removal of the adapter 202 from the lip 232 in a manner already described with respect to FIG. 3.

Focusing on the adapter 202 and stop member 236 of FIGS. 4 thru 9, it can be seen that there are four stop members 236 that are adjacent the upper and lower legs 212, 216 on the right and left sides. Each of the stop members 236 are identical and have two abutment surfaces 262, 264 adjacent each other (shown in FIGS. 13 and 14). These abutment surfaces 262, 264 contact complimentary shaped abutment surfaces on the rearward abutment face 226 of the protrusion 227 and side surface 214, 218 of a leg 212, 216. This provides additional reinforcement in at least two directions, such as the X and Y directions. The nose 210 includes a boss 240 on a side surface that is used in retaining a tip or tool to the nose of the adapter using a method and device that is known in the art.

Figure 8:
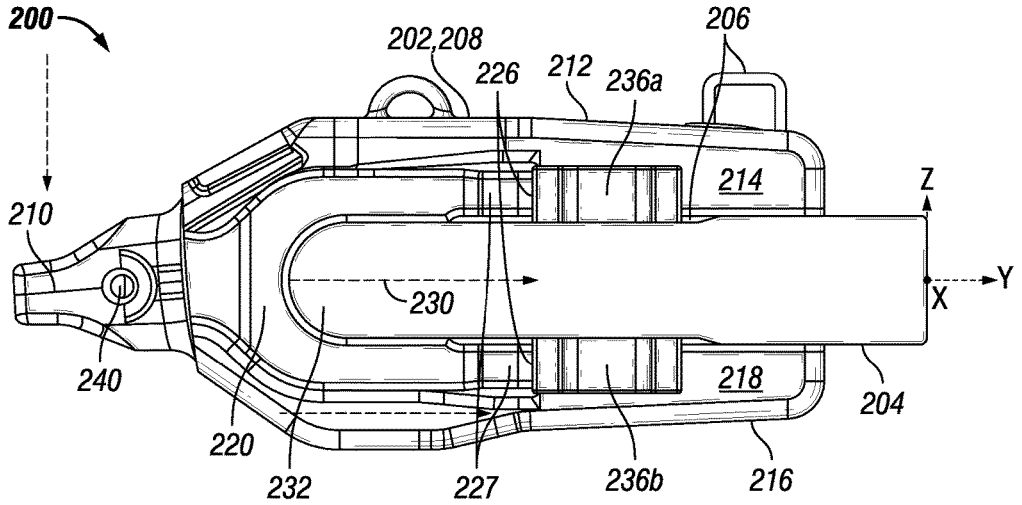
FIG. 8 illustrates how the components of FIGS. 4 thru 7 work, and more specifically, how the stop member prevents movement of the bottom leg of the tool adapter when a downward load is applied to the nose of the adapter.

FIG. 8 shows that if a downward force is applied to a tool or tip (not shown), that force is transferred to the nose 210 of the adapter 202 and through the bottom leg 216 which contacts the bottom stop member 236*b*. This prevents movement or buckling of the bottom leg, reducing the stress in the leg. The abutment surface 226 of the protrusion 227 and stop member 236 are both closer to the throat 220 in the negative Y direction than the aperture 222 of the adapter 202 (best appreciated by comparing FIGS. 7 and 8). This provides more strength by moving the abutment surface 226 away from the aperture 222.

Returning to FIG. 8, when an upward force is exerted on the nose 210, then the top stop member 236*a* would prevent the top leg 214 from moving in the Y direction, preventing an undesirable stress in the top leg.

Figure 9:
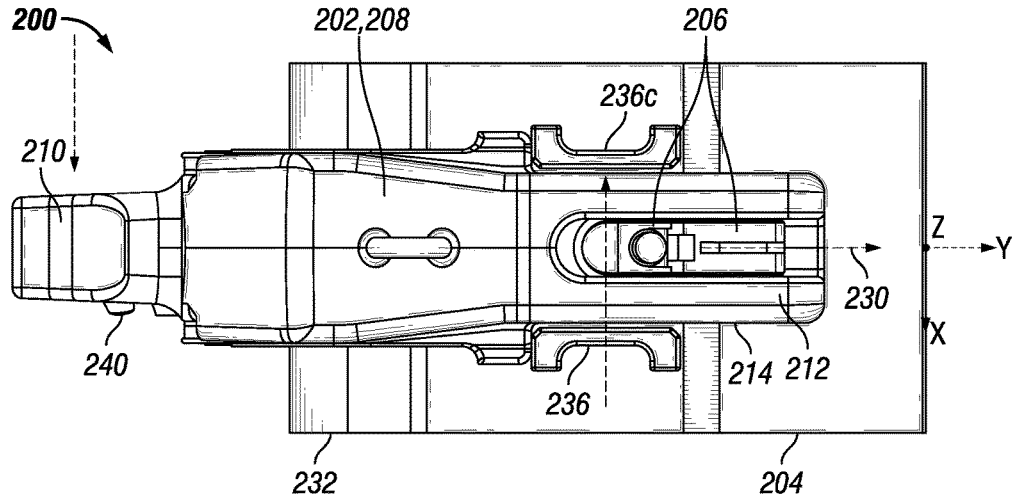
FIG. 9 illustrates how the components of FIGS. 4 thru 7 work, and more specifically, how the stop members prevent movement of the legs of the tool adapter when a sideward load is applied to the nose of the adapter.

On the other hand, FIG. 9 shows what happens if the nose 210 of the adapter 202 experiences a side load in the direction as shown in this figure. Then the top stop member 236*c* as shown in this figure presses down on the side abutment surface 242 of the adapter 202 (see FIGS. 13 and 14), preventing it from shifting causing unwanted stress.

Figure 10:
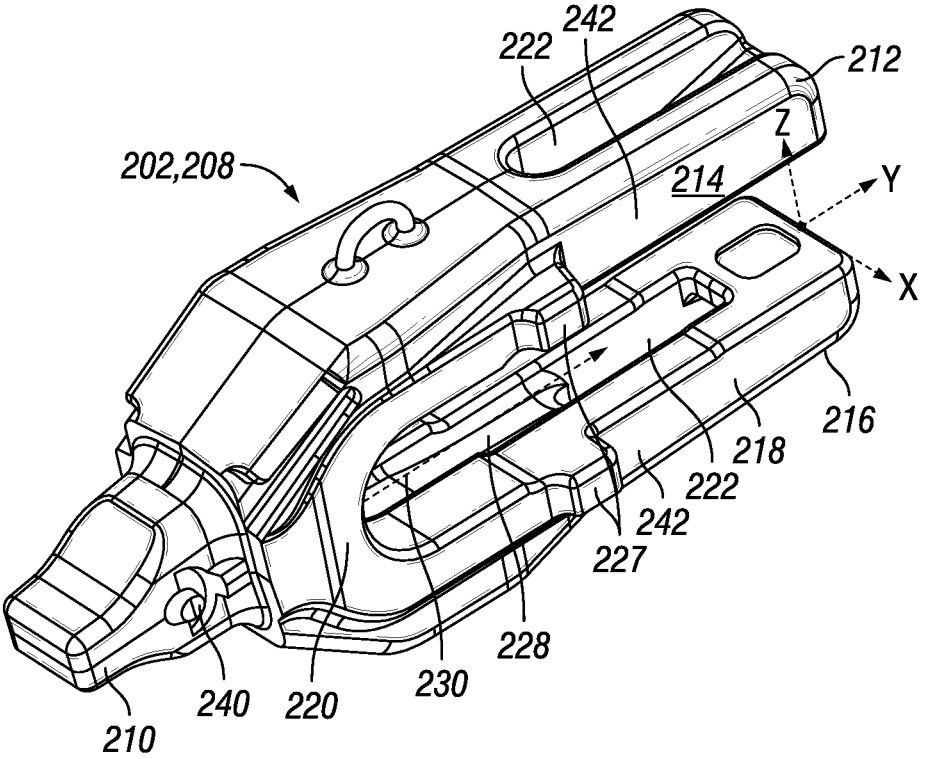
FIG. 10 is a perspective view of the tool adapter of FIGS. 4 thru 9 shown in isolation.

Turning the reader's attention now to FIGS. 10 thru 12, various views of the tool adapter 202 shown in FIGS. 4 thru 9 can be seen in isolation. As mentioned previously, the tool adapter 202 includes a body 208. The body 208 includes a nose portion 210, a first leg 212 that includes a side surface 214, a second leg 216 that includes a side surface 218, a throat portion 220 that connects the legs 212, 216 and nose portion 210 together, and at least one leg that defines an aperture that is configured to receive a retaining mechanism. For this embodiment, both legs 212, 216 have this aperture 222. It should be noted that X, Y, Z coordinates are provided and that the adapter body 202 is symmetrical about the Y-Z plane except for the boss 240 of the nose 210. Also, the legs 212, 216 and their protrusions 227 are fairly symmetrical about the X-Y plane.

For this embodiment as shown, the first and second legs 212, 216 and the throat portion 220 define a slot 228 that includes a closed end and an open end. The slot defines a direction 230 of assembly onto a work implement, which is shown to be the Y direction. The X direction would run essentially parallel to the lip of a work implement to which the adapter would be attached. The minimum distance 234 measured from the abutment surface to the throat measured in the direction (Y) of assembly is less than the minimum distance 237 from the aperture to the throat measured in the direction (Y) of As shown abutment surface is substantially perpendicular to the direction (Y) of assembly. As used herein, reference to a substantial value of an angle means that it is within 5 degrees of that angle, which may be equivalent to a draft angle that many of the components such as the adapter might have in order to facilitate removal of the part from a mold or casting apparatus. Also as shown, the abutment surface 226 is a rearward abutment surface meaning that it faces in the Y direction.

The protrusion 227 has a predetermined height in the Z direction, width, in the Y direction, and depth in the X direction. Alternatively, the height, width and depth may be expressed as a thickness in the X, Y and Z directions. The thickness 246 of the protrusion 227 measured along the Y direction may be at least 40 mm, and may be preferably at least 60 mm. The thickness 248 of the protrusion 227 measured along the X direction may be at least 20 mm, and more preferably at least 40 mm. The thickness 250 of the protrusion in the Z direction may be at least 40 mm, and more preferably at least 60 mm. The shape and size of these thicknesses and the protrusion may be modified as needed depending on the application.

In most cases, the side surface 214, 218 of a leg 212, 216 is configured to act as a side abutment surface 242. Otherwise, the depth of the protrusion in the X direction would have to be great enough so that a stop member could be far way enough to avoid touching the side surface of the leg of the adapter body. When the side surface of the leg is a side abutment surface, it is often substantially perpendicular to the X direction but not necessarily so.

Looking at FIG. 12, the side surface 214, 218 of a leg 212, 216 moves in the X direction along the Y direction. More specifically, the side surface 214, 218 moves inwardly toward the aperture 222 along the Y direction toward the rear of the adapter 202 (see portion 203 in FIGS. 12 and 17), decreasing the thickness of the adapter near its rear end. It is contemplated that the side surface of the leg may not move or jog in other embodiments of the present disclosure.

Any abutment surface discussed herein may form an acute or obtuse angle with any Cartesian plane as needed or desired. Such an example is given later with respect to FIG. 17.

Figure 14:
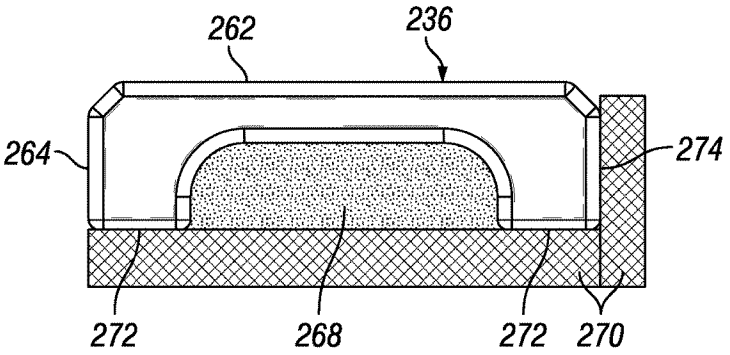
FIG. 14 is a top view of the stop member of FIG. 13 showing various methods of attachment to a lip.
Figure 13:
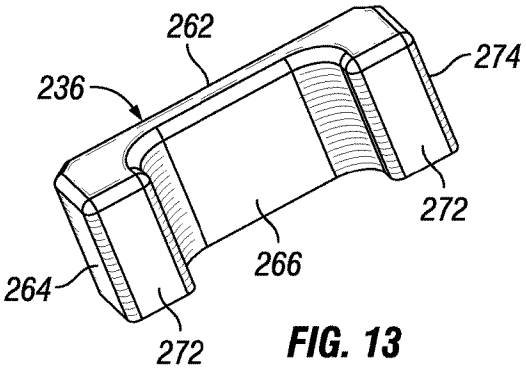
FIG. 13 is a perspective view of the stop member of FIGS. 4 thru 9.

Looking now at FIGS. 13 and 14, the details of the stop member 236 of FIGS. 4 thru 9, which for this embodiment is a weldment, can be seen. The stop member 236 is generally "U" shaped with a side abutment surface 262 that is configured to complimentary match the side abutment surface 242 of the legs 212, 216 of the adapter 202 of FIGS. 4 thru 9.

Similarly, the stop member 236 includes a front abutment surface 264 that is configured to complimentary match the rear abutment surface 226 of the adapter 202. It should be noted that any type of surface may be used as an abutment surface as described herein, including but not limited to, undulating, flat or straight, compound angled, etc. The "U" shape of the stop member 236 creates a nest or recess 266 that is suitable for use with a plug or fillet weld 268, to attach the weldment to the lip of a work implement. Alternatively, the weldment could be attached using fillet welds 270 that touch the back side surfaces 272 that straddle the recess 266 and that touches the rear face 274 of the weldment. Or, some combinations of these welds may be used. The configuration of this stop member minimizes its profile such that it is shielded by the side protrusion of the adapter, limiting its contact with work material such as rocks and the like, which decreases its wear and may prolong its life. Furthermore, this configuration minimizes the amount of material needed to make the weldment, reducing cost.

Figure 16:
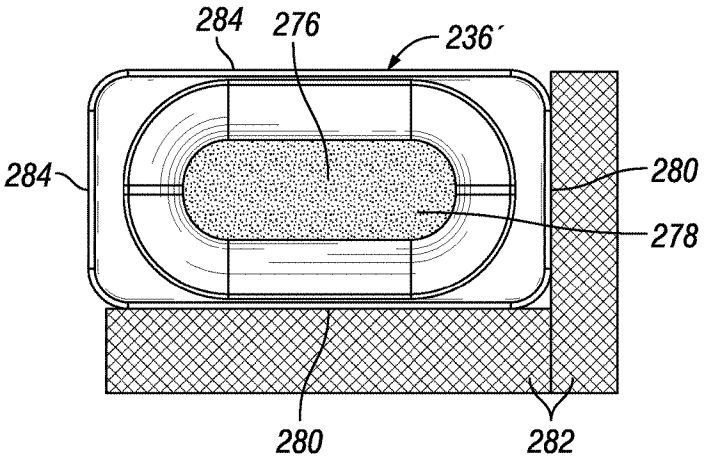
FIG. 16 is a top view of the stop member of FIG. 15 showing various methods of attachment to a lip.
Figure 15:
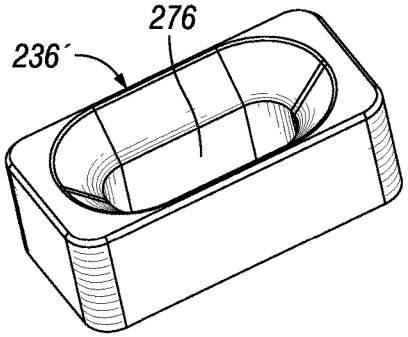
FIG. 15 is an alternate embodiment of a stop member.

Yet another embodiment of a stop member 236' in the form of a weldment is illustrated by FIGS. 15 and 16. This stop member 236' may be described as being approximately the same as what one would get if the stop member 236 of FIGS. 13 and 14 was mirrored about a plane coincident with the back side surfaces 272 of that stop member 236. Hence, the stop member 236' of FIGS. 15 and 16 defines a substantially rectangular perimeter and a well or pocket 276 in its center that is configured for use with a plug weld 278 for attaching it to the lip of a work implement. Alternatively, the surfaces 280 not being used as abutment surfaces could be used to connect the weldment to the lip using fillet welds 282. The advantage that this design has is that it helps to avoid assembly error as a 180 degree rotation about an axis through the pocket yields effectively the same end result. Suitable abutment surfaces 284 of the weldment would contact complimentary shaped abutment surfaces on the adapter. In some cases, both types of plug and fillet welds may be used.

Figure 17:
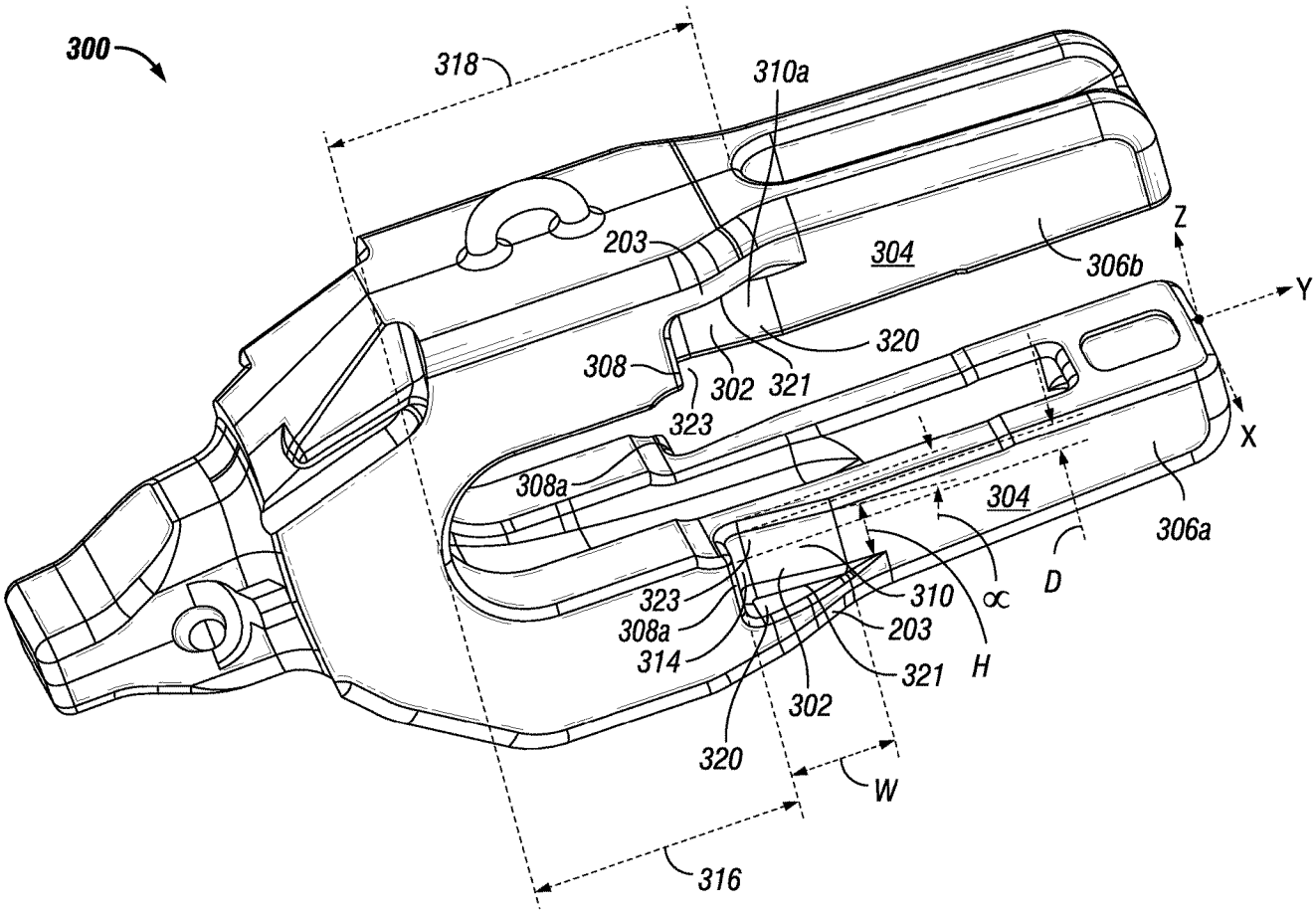
FIG. 17 is a perspective view of another tool adapter according to another embodiment of the present disclosure.

FIG. 17 depicts another embodiment of the tool adapter 300. This embodiment is similarly constructed and has similar features as that described for the tool adapter 300 of FIGS. 4 thru 9 except the following adjustments have been made. In lieu of a projection, pockets 302 are provided on the side surfaces 304 of the legs 306 of the adapter 300. The pockets 302 are defined by a rear abutment surface 308 and a side abutment surface 310. The rear abutment surface 308 is substantially perpendicular to the Y direction while the side abutment surface 310 is angled relative to the Y direction making an angle $\alpha$ of approximately 10 degrees. In other words, the pocket is partially defined by a surface 310 that forms an oblique angle $\alpha$ with the Y direction that may have a value of about 10 degrees. A stop member could be provided for use with this embodiment of the tool adapter that has complimentary shaped abutment surfaces that would contact these abutment surfaces of the tool adapter simultaneously. Also, the pocket is configured with an opening 320 that faces toward the direction of assembly. A surface 321 is also provided that faces in a direction that is perpendicular to the direction of assembly. Following a surface normal from this surface 321, one can see that there is an opening 323 that is also perpendicular to the direction of assembly that communicates with slot (labeled 228 in FIG. 11).

Alternatively, the angled surface 310 of the pocket 302 may only provide clearance so that a corner of the stop member does not limit its contact with the rear abutment surface. This angle also allows for the provision of a more generous blend 314 between the angled surface and the rear abutment surface, which reduces stresses when a load is applied to the rear abutment surface. It can also be seen that the blend connects the angled surface to the abutment surface. In such an embodiment, the side surface of the leg may serve as a side abutment surface.

Similar to the protrusion 227 described above for other embodiments, the pocket has a predetermined height H in the Z direction, width W, in the Y direction, and depth D in the X direction. The width of the pocket measured along the Y direction may be at least 40 mm, and may be preferably at least 130 mm. The depth of the pocket measured along the X direction may be at least 20 mm, and more preferably at least 40 mm. The height of the pocket in the Z direction may be at least 40 mm, and more preferably at least 60 mm. The shape and size of the pocket and surfaces that define it may be modified as needed depending on the application.

Also, the relative placement of the pocket relative to the clearance pocket, throat and transition portion that blends the clearance pocket into the slot that is defined by the legs and throat is the same as that described above with respect to embodiments that include the protrusion. The minimum distance 316 from the rear abutment surface to the throat in the Y direction is less than the minimum distance 318 from the aperture of the legs to the throat.

INDUSTRIAL APPLICABILITY

In the field, it is problematic when a tool adapter stops working. This may incur a significant cost to a mining, construction, or other economic endeavor. At the same time, it may be prohibitively expensive to replace all the systems that use the tool adapter, work implements and associated lip construction, and tool retaining mechanisms shown in FIG. 3. Thus, a method for retrofitting such systems in the field in a cost effective manner is warranted. Retrofitting kits or assemblies that use the improved reinforcement system described herein may be made or sold that contain any tool adapter or stop member construction described herein. Such a kit may or may not also contain a retaining mechanism depending on the need. A method of modifying a work tool assembly will now be described. This method also applies to the sale or creation of new systems or assemblies.

Figure 4:
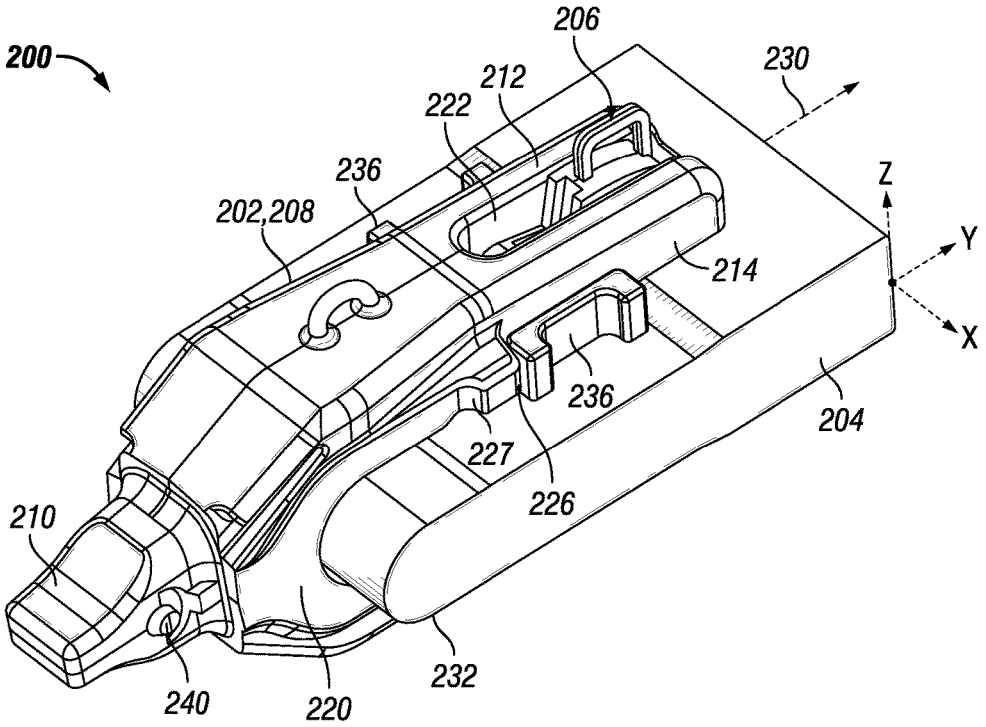
FIG. 4 is a perspective view of a tool adapter, retaining mechanism and stop member that are attached to a lip of a bucket according to an embodiment of the present disclosure.
Figure 5:
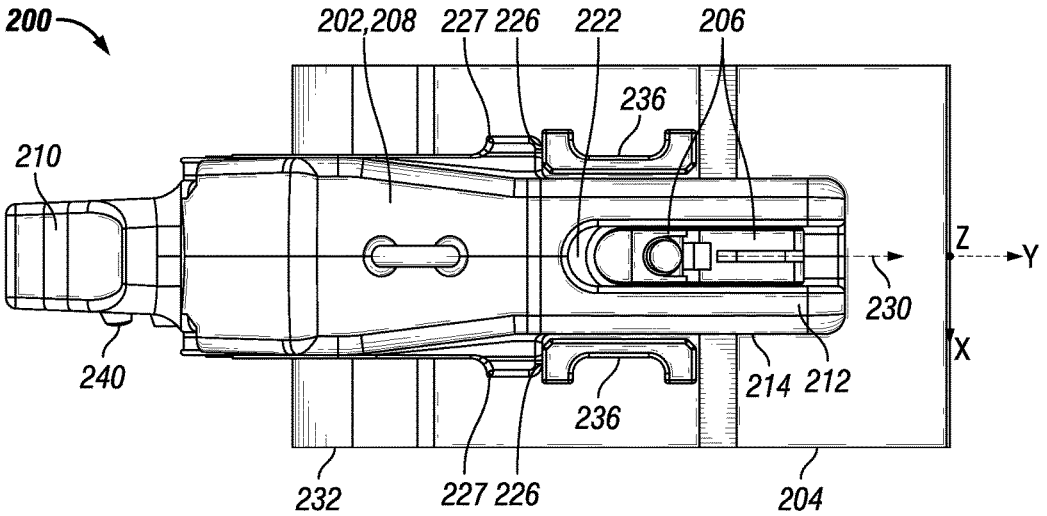
FIG. 5 is a top view of the tool adapter, retaining mechanism, and stop member and lip of a bucket as shown in FIG. 4.
Figure 18:
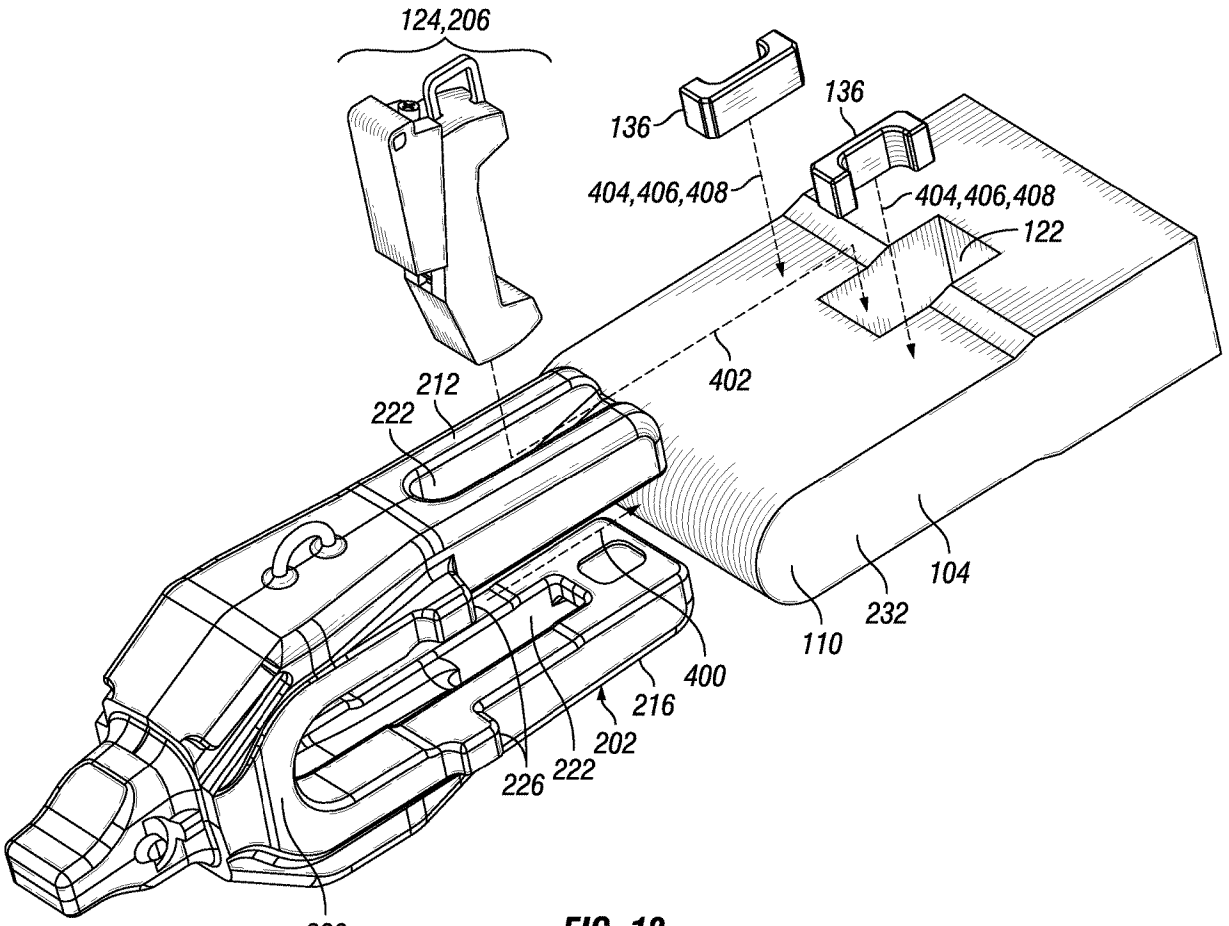
FIG. 18 is an exploded assembly view showing how the tool adapter, retaining mechanism and stop members are attached to the lip of a bucket.

FIG. 18 is an exploded assembly view of the system of FIG. 4 that may be used to retrofit an existing system or create a new system for applying and reinforcing a tool adapter to a work implement.

First, the method for modifying a work tool assembly includes the step of providing a work implement that includes a lip 104 including a front edge 110 and an aperture 122 therethrough, a tool adapter assembly that includes a retaining mechanism 124, a stop member 236, and a tool adapter 202 that defines an aperture 222 and includes legs 212, 216, an abutment surface 226, and a throat 220. These requisite parts may be provided in a number of ways. This includes situations where one or more components are manufactured, sold, bought, are already present in the field, etc.

The method further comprises the steps of sliding the legs 212, 216 of the tool adapter 202 onto the lip until the throat of the adapter is proximate the front edge or actually contacts the front edge and the apertures 122, 222, of the lip and tool adapter are at least partially aligned (see step 400 of FIG. 18), using the retaining mechanism to attach the tool adapter onto the lip (step 402) by inserting the retaining mechanism into the apertures of the lip and adapter, and attaching the stop member to the lip at a place that is proximate the abutment surface of the adapter once both the stop member and adapter are attached to the lip (step 404). This may provide reinforcement to the adapter along the direction of the assembly of the adapter, as is the case when a front or rearward abutment face is provided. The step of attaching the stop member to the lip may occur after the step of using the retaining mechanism to attach the tool adapter onto the lip.

Doing the steps in this order has the added benefit of allowing the abutment surfaces of the adapter to be in their proper position with the throat of the adapter being pressed against the front edge of the lip of the work implement. Then when the stop member is attached, its abutment surfaces will be precisely aligned with those of the adapter and be in the proper position to provide adequate support. Alternatively, the stop member may be attached to the lip before the tool adapter but this requires accurate measurement of the position of the stop members which may be difficult, especially in the field. Fixtures may make this feasible in a manufacturing environment. In any case, the abutment surface may be positioned between the throat and the aperture of the adapter along the direction of assembly of the adapter as has been previously described but this may not be always the case.

The step of attaching the stop member may include welding the stop member to the lip (step 406). Or, it may include fastening the stop member to the lip (step 408) for reasons already explained with reference to FIG. 17 above. Also, the step of sliding the adapter off the lip may be done without detaching the stop member. This is true when the stop member does not create an undercut in the direction of disassembly as is the case for the embodiment of FIGS. 4 and 18. However, it is contemplated that the stop member of these figures could be placed in front of the protrusions instead of behind them and abut the front face of the protrusion and side surface of the leg there (see FIG. 12). In which case, the stop member would need to be detached before removing the adapter.

It is also contemplated that the stop members may be directly cast into the lip. This may eliminate the need of attaching stop members after the lip has been fabricated or cast. Also, replaceable wear pads may be placed on the stop members to form the abutment surfaces. This may necessitate another assembly or disassembly step of bolting the wear pad onto the stop member.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, it is intended that the specification and examples be considered as exemplary only, with a true scope and spirit of the invention(s) being indicated by the following claims and their equivalents.

What is claimed is:

1. A tool adapter for attaching a tool to a work implement using a retaining mechanism, the adapter comprising:

a body that includes:

a nose portion that is configured to facilitate the attachment of a tool;

a first leg that includes a side surface;

a second leg that includes a side surface;

a throat portion that connects the legs and nose portion together;

at least one of the first leg and the second leg defines an aperture that is configured to receive a retaining mechanism; and the body defines a pocket that defines an abutment surface, the pocket is located on a side surface of at least one of the first leg and the second leg and the pocket includes a height, width and depth, the pocket is configured with an opening facing toward the direction of assembly, and the pocket includes a bottom pocket surface that faces in a direction not parallel to the direction of assembly:

wherein the first and second legs and the throat portion define a slot that includes a closed end and an open end, the slot defining a direction of assembly onto a work implement, and wherein the abutment surface faces toward the direction of assembly and the minimum distance measured from the abutment surface to the throat measured in the direction of assembly is less than the minimum distance from the aperture to the throat measured in the direction of assembly.

2. The adapter of claim 1 wherein the abutment surface is substantially perpendicular to the direction of assembly.

3. The adapter of claim 1 wherein the side surface is the abutment surface.

4. The adapter of claim 1 wherein the pocket is partially defined by a pocket side abutment surface that forms an oblique angle with the direction of assembly.

5. The adapter of claim 4 wherein the angle is about 10 degrees.

6. The adapter of claim 4 wherein the body further includes a blend that connects the pocket side abutment surface that forms an oblique angle with the direction of assembly to the abutment surface.

7. The adapter of claim 4 wherein the pocket is configured with an opening facing a direction that is perpendicular to the direction of assembly.

8. The adapter of claim 7 wherein the bottom pocket surface faces in a direction that is perpendicular to the direction of assembly.

9. A tool adapter assembly comprising:

a work implement that includes a lip;

a tool adapter for attaching a tool to a work implement using a retaining mechanism, the tool adapter comprising:

a body that includes:

a nose portion;

a first leg that includes a side surface;

a second leg that includes a side surface;

a throat portion that connects the legs and nose portion together;

at least one of the first leg and the second leg defines an aperture that is configured to receive a retaining mechanism; and wherein the body defines a reinforcement surface;

wherein the first and the second legs and the throat portion define a slot that includes a closed end and an open end; the slot defining a direction of assembly onto the work implement, and wherein the minimum distance measured from the reinforcement surface to the throat measured in the direction of assembly is less than the minimum distance from the aperture to the throat measured in the direction of assembly; and a stop member that is at least partially complimentary configured to mate with the reinforcement surface;

wherein the body of the tool adapter defines a pocket and the reinforcement surface at least partially defines the pocket, and the pocket is located on a side surface of at least one of the first leg and the second leg and the pocket includes a height, width and depth, the pocket is configured with an opening facing toward the direction of assembly, and the pocket is partially defined by a pocket side abutment surface that forms an oblique angle with the direction of assembly and a pocket bottom surface.

10. The assembly of claim 9 wherein the tool adapter is configured to slide onto the lip and the body of the tool adapter further includes a blend that connects the pocket side abutment surface that forms an oblique angle with the direction of assembly to the reinforcement surface.

11. The assembly of claim 10 wherein the stop member is integrally formed on the lip.

* * * * *